United States Patent [19]

Joslyn

[11] 4,355,481

[45] Oct. 26, 1982

[54] MECHANICAL CAROUSEL TOP

[76] Inventor: John Joslyn, Bayview Ave., Sag Harbor, Long Island, N.Y. 11963

[21] Appl. No.: 224,393

[22] Filed: Jan. 12, 1981

[51] Int. Cl.[3] ..... A63H 1/06

[52] U.S. Cl. ..... 46/68

[58] Field of Search ..... 46/68, 67, 66, 65, 64; 272/31 R

[56] References Cited

U.S. PATENT DOCUMENTS

| | | | |
|---|---|---|---|
| 3,785,081 | 1/1974 | Burkhart | 46/68 X |
| 3,983,659 | 10/1976 | Wasson | 46/68 |
| 4,211,030 | 7/1980 | Morrison et al. | 46/67 |

FOREIGN PATENT DOCUMENTS

| | | | |
|---|---|---|---|
| 15796 | of 1896 | United Kingdom | 46/68 |

*Primary Examiner*—Paul J. Hirsch
*Assistant Examiner*—Mickey Yu
*Attorney, Agent, or Firm*—Arthur T. Fattibene

[57] ABSTRACT

A toy mechanical carousel top having a base stand on which a turn table is rotatably mounted to rotate relative thereto, and which turn table is rotated by a drive that includes a driver and a unidirectional clutch assembly actuated by a reciprocating plunger. One or more animated figures are connected to the turn table so as to be retained on the turn table as it rotates, and which figures can be rendered readily detachable therefrom. A musical sounding device is operatively associated with the turn table to emit a pleasing sound as the turn table turns.

7 Claims, 8 Drawing Figures

MECHANICAL CAROUSEL TOP

PRIOR ART

Mechanical spin tops are known. Such known mechanical spin tops are generally formed so that the entire top spins when it is actuated. As a result, there is a tendency of such top to travel over a surface as it spins. For this reason, such tops are not generally suitable for small children such as for example children in the age of one to three years. Also, such known spin tops are limited in play value since such toy tops only play value is as a top.

OBJECTS

An object of this invention is to provide a toy top which is particularly suitable for children of very tender years and which is simple to operate, relatively inexpensive to fabricate and which is positive in operation.

Another object is to provide a toy mechanical spin top which is maintained in a fixed position as it rotates.

Another object is to provide a toy mechanical spin top simulating a carousel spinning on a fixed base and having one or more animated figures arranged to be retained of the top when spinning and yet which are rendered readily detachable therefrom.

Another object is to provide a mechanical carousel toy top having enhanced play value and which is amusing and pleasing to young children.

BRIEF SUMMARY OF THE INVENTION

The foregoing objects and other features and advantages are attained by a toy carousel top comprising a base stand upon which a turn table is rotatably journalled. A drive is provided for imparting rotation to the turn table. In a simplified arrangement the drive in the form of a twist rod which is longitudinally displaceable relative to a unidirectional clutch for imparting a rotatable movement to the turn table as the twist rod is displaced in one direction and wherein the clutch is disengaged as the twist rod is released to render the turn table free wheeling due to the inertia imparted thereto upon the initial displacement of the twist rod. Additional play value is imparted to the carousel top by disposing an audio sounding device which is actuated to sound a pleasing sound as the turn table spins and removable animated objects are located on the turn table. In another embodiment the drive comprises of a twist rod which is operatively connected to a clutch, to effect the engagement and disengagement of the drive, and a drive which is longitudinally displaceable relative to the twist rod. The drive is connected to the turntable so as to impart rotation thereto as the driver is displaced along the twist rod. A reciprocating plunger is operatively associated with the driver and associated clutch whereby a child of young years can effect operation of the top simply by applying a slight displacement force on the plunger. Mounted on the turn table are one or more animated figures which are frictionally retained in seats provided therefor. The arrangement is such that the figures are retained in place on the turn table when spinning, and yet are rendered readily displaceable therefrom whereby the figures can be separately played with as dolls and/or enables the young child to exercise his manual dexterity by placing and/or removing the figures from their respective seats. A musical note producing means is also included in the top to generate a pleasing and amusing sound as the top spins.

FEATURES

A feature of this invention resides in the provision of a carousel top having a stationary base on which the turn table rotates relative thereto.

Another feature resides in the provision of a reciprocating drive which includes a driver connected to the turn table which is longitudinally displaceable along a twist rod so as to effect rotation of the turn table when displaced in one direction only.

Another feature resides in the provision of animated figures which are detachably connected to the turn table and frictionally retained as the turn table rotates.

Another feature resides in the provision of a reciprocating drive for the turn table in which the drive is disengaged when the driver is displaced in one direction and in which the drive is engaged when the driver displaced in the other direction.

Another feature resides in the provision of an audio device which is disposed relative to the turn table to be actuated thereby as it rotates.

Other features and advantages will become more readily apparent when considered in view of the drawings and specifications in which.

DETAILED DESCRIPTION

Figure 2:
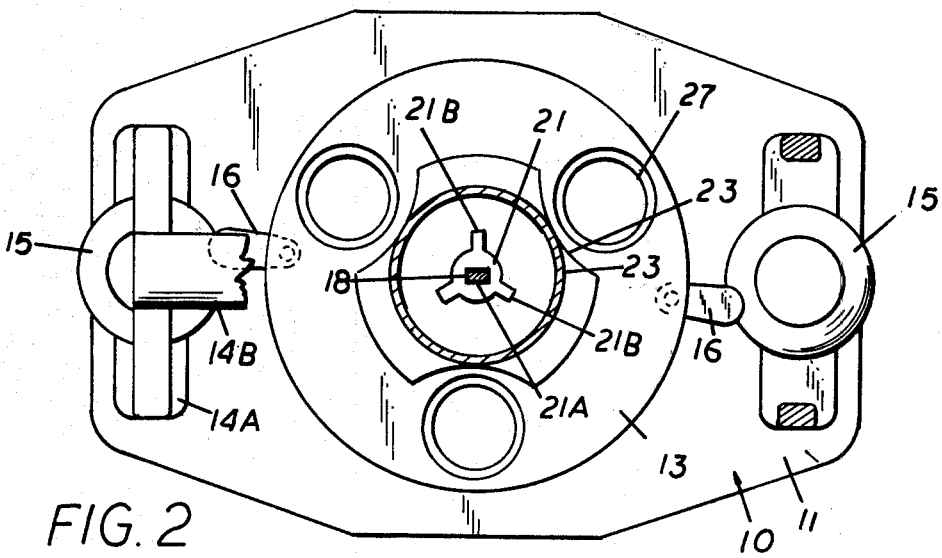
FIG. 2 is a top plan view of the FIG. 1 having portions broken away.
Figure 1:
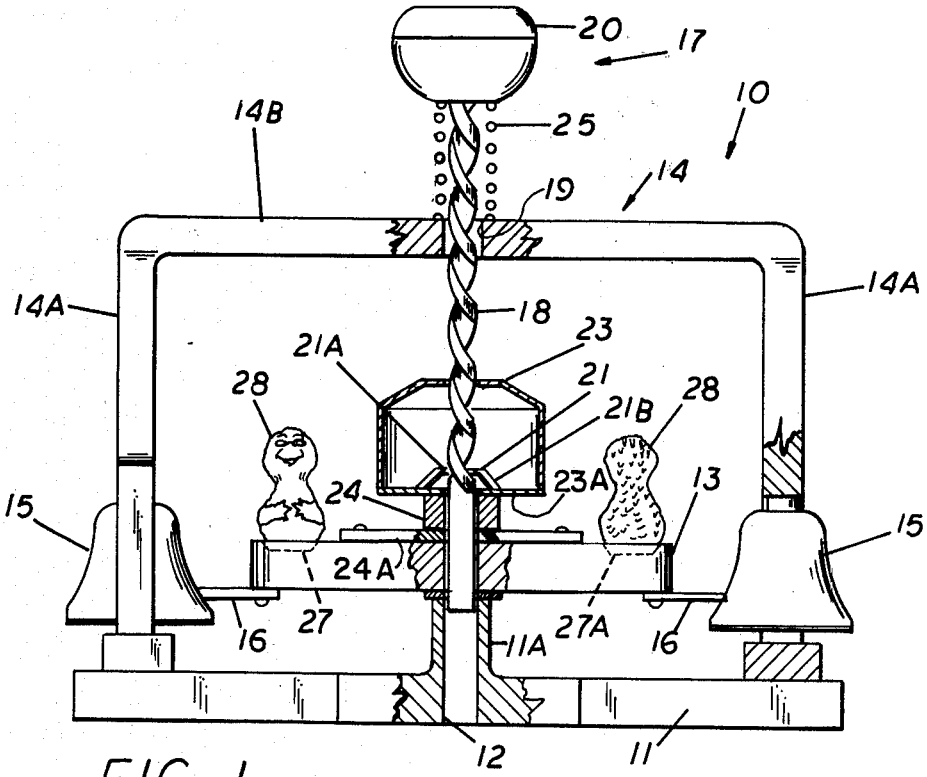
FIG. 1 is a side elevation view of an embodiment of the invention.
Figure 8:
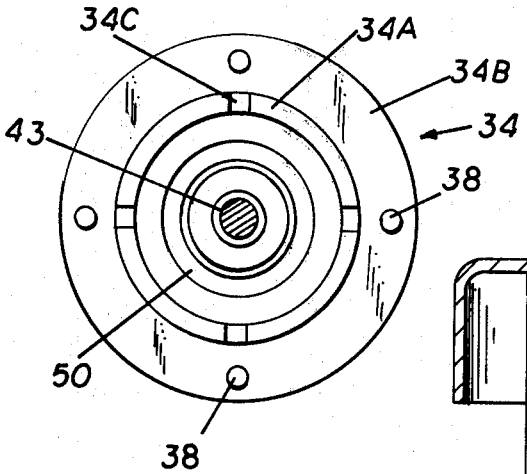
FIG. 8 is a plan view taken on line 8—8 on FIG. 3.

Referring to the drawings viz. FIGS. 1 and 2, there is shown a carousel top 10 embodying the present invention. As shown, the carousel top 10 comprises a base 11 having a hub portion 11A formed with a bore 12 therein. Rotatably journalled on the end of the hub portion 11A is a turn table 13. The turn table 13 is provided with a central opening 13A disposed in alignment with the bore 12 of hub 11A.

Mounted on the base 11 and extending upwardly therefrom is a upper frame 14, which as illustrated comprises an inverted U shaped member. The U shaped frame 14 has opposed leg portions 14A—14A and an interconnected cross member 14B. The respective lower portions of the opposed leg portions 14A, 14A are bifucated and an audio sounding means in the form of a tone bar or bell 15 is mounted thereat. Connected to the turn table and pivotally mounted thereto are one or more hammers or strikers 16. Preferrably, the strikers or hammers 16 are pivotally connected so that when subjected to the centrifugal forces of the rotating table 13, the strikers will project radially outwardly from the table to strike the bell or tone bar 15 as the table rotates.

To effect an unidirectional drive of the turn table 13, a drive means 17 is provided. The drive means 17 includes a twist bar or driver 18 which extends through an opening 19 formed in the cross member 14B and which twist bar 18 extends into the bore 12 of the base hub 11A. An operating knob 20 is suitably connected to the upper end of the twist rod. Essentially, the twist bar 18 is formed with a generally rectangular cross sectional shape member which is twisted as shown. An unidirection clutch means is operatively associated with the twist bar 18. The clutch means includes a resilient member 21 having a centrally disposed rectangular slot 21A and a plurality of radially extending grippers 21B. The clutch member 21 is confined within a housing 23 which is fixed to a flanged bushing 24. The flange portion 24A of the bushing 24 in turn is connected to the turntable 13.

To effect the drive of the turn table 13, the twist bar 18 is extended through the rectangular slot 21A of the clutch member 21. The arrangement is such that when the twist bar 18 is depressed, i.e., displaced downwardly as seen in FIG. 1, the fingers or grippers 21B are brought into frictional bearing relationship with the base portion 23A of the housing 23 with the twist bar imparting rotation to the clutch member 21 and table connected in driving relationship thereto. Upon release of the depressing pressure applied to the twist bar 18, a spring 25 will function to return the twist bar to its normal raised position. The pressure thus being relieved will disengage the clutch member 21 whereby the turntable 13 will freely rotate or spin due to the inertia imparted thereto by the depression of the twist bar 18. The turntable is thus rendered free wheeling. In spinning, the hammer or strikers 16 are extended to strike the bells 15 as the turn table turns or spins; thereby sounding a musical or pleasing tone each time the striker passes by the bell. By periodic and repeated depressings of the twist bar, the spinning of the carousel top 10 can be continued and/or speeded up; all the while the top relative to its supporting surface remains stationary or fixed.

The spinning top 10 can further simulate a carousel by providing the turn table 13 with a plurality of circumferentially spaced seats or recesses 27 for detachably receiving an animated object, such as a little doll or the like 28, with squeaker.

FIGS. 3 to 6 illustrate a modified embodiment. In this embodiment the carousel top 30 comprises a base member 31 which is provided with a central recessed portion 31A, the outer surface of which is provided with a series of radially disposed serations or teeth 32 and which define one member of a clutch means will be hereinafter described. The base member is shown as being generally dish shaped in configuration having a hollow sleeve formed integral therewith. Rotatably journalled on the sleeve 33 is a turntable hub 34. A flanged eyelet 35 defines the bushing or bearing by which the turntable hub 34 is rotatably secured to the sleeve 33.

Secured to the turntable hub 34 to rotate therewith, as will be hereinafter described in the turn table 36. In the illustrated embodiment the turntable 36 comprises a complementary inverted dish shaped portion 36A having a central outwardly projecting boss or stem portion 36B. Disposed within the stem portion 36B are a plurality of circumferential spaced, radially disposed flanges or webs 37 which extend the length of the stem portion 36B. The turntable hub 34 is provided with an annual ring 34A which extends from a flange portion 34B thereof. The ring 34A is provided with a series of slots 34C which are arranged to accommodate the webs 37 of the stem portion 36B. In the assembled position the web 37 disposed in complementary slots 34C thus couples the turntable 36 to the hub 34 whereby both will turn in unison when the top is actuated. To secure the turntable 36 to its hub 34, the latter is provided with a plurality of pins 38 formed integral with the flange 34B of the hub, and which pins 38 are received in complementary holes or seats 39 connected or formed on the turn table 36. With the construction thus described it will be noted that the turntable 36 is fixedly connected to the hub 34 to rotate therewith.

Mounted on the upper end of the turntable stem portion 36B is an actuator in the form of a plunger 40 arranged to be longitudinally displaceable relative to the stem portion 36B. The plunger comprises essentially of an elongated sleeve member 40A having a stop flange 40B circumscribing the inner end thereof. Connected to the upper end of the plunger sleeve is a plunger top 40C which is suitably secured by a pin or fastener 41.

A driving means for effecting the drive for the top comprises a twist bar 43 and an associated driver 44. The twist bar 43 is a generally rectangular shape bar which is formed with a helical twist as shown. The lower end of the twist bar 43 is fixedly connected to a ratchet or complementary clutch member 45.

Figure 4:
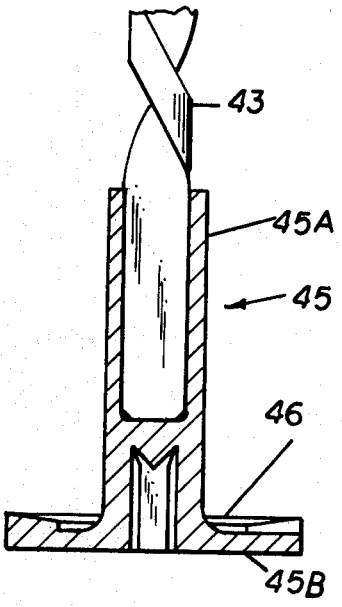
FIG. 4 is a detail sectional view of the clutch member.
Figure 6:
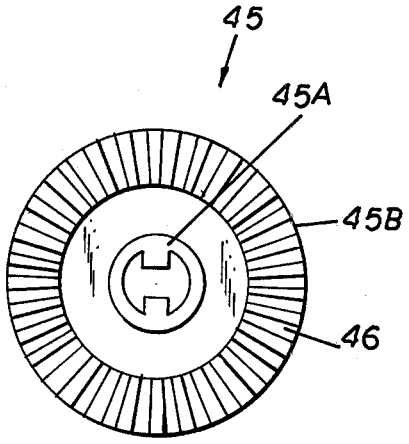
FIG. 6 is a top view of FIG. 5.
Figure 7:
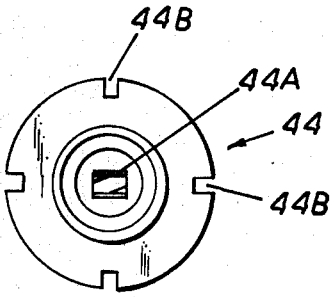
FIG. 7 is a detail plan view of the driver.
Figure 5:
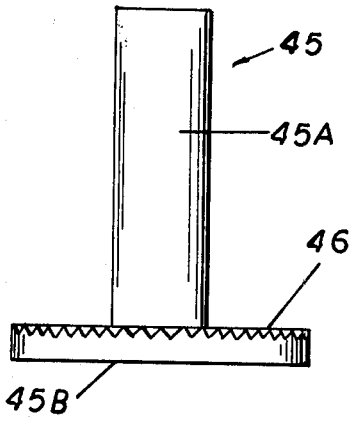
FIG. 5 is an end elevation view of FIG. 4.

Referring to FIGS. 4 to 6, the clutch member 45 comprises a boss portion 45A which is adapted to be received within sleeve 33 about which the turntable hub 34 rotates. Connected to the lower end of the boss portion 45A is a flange 45B which has radially extending teeth or serrations 46 disposed to complement and mesh with teeth 32 of the base member 31. A closure or disk 47 is disposed over the recess 31A to confine the clutch member within the recess 31A. Connected to the closure 47 is a pin 47A which functions as a guide pin for the clutch member 45 as it will be hereinafter apparent. Thus, the base of the clutch member 45 is provided with a recess 48 for accommodating the guide pin 47A.

The upper end of the twist rod or bar 43 is extended through a central opening 44A formed in the driver 44. The driver is provided with a plurality of circumferentially spaced slots 44B for accommodating the webs 37 of the stem portion 36B. The lower end of the plunger 40 abutts against the driver, and the arrangement is such that the driver is longitudinally displaced within the stem 36B as the plunger 40 is depressed. A spring 49 normally biases the driver 44 and the associated plunger toward the inoperative position shown in FIG. 3, the spring acting on the driver 44 causes the clutch member 45 connected to the twist bar 43 to be disposed in meshing relationship with the teeth 32 of the base member. It will be noted that the closure or cover 47 is slightly spaced from the bottom of the clutch member 45. See FIG. 3. This space 60 thus provides for sufficient displacement of the clutch member 45 from the teeth 32 so as to effect engagement and disengagement of the clutch members or teeth 32 and 46 as will be herein described.

Figure 3:
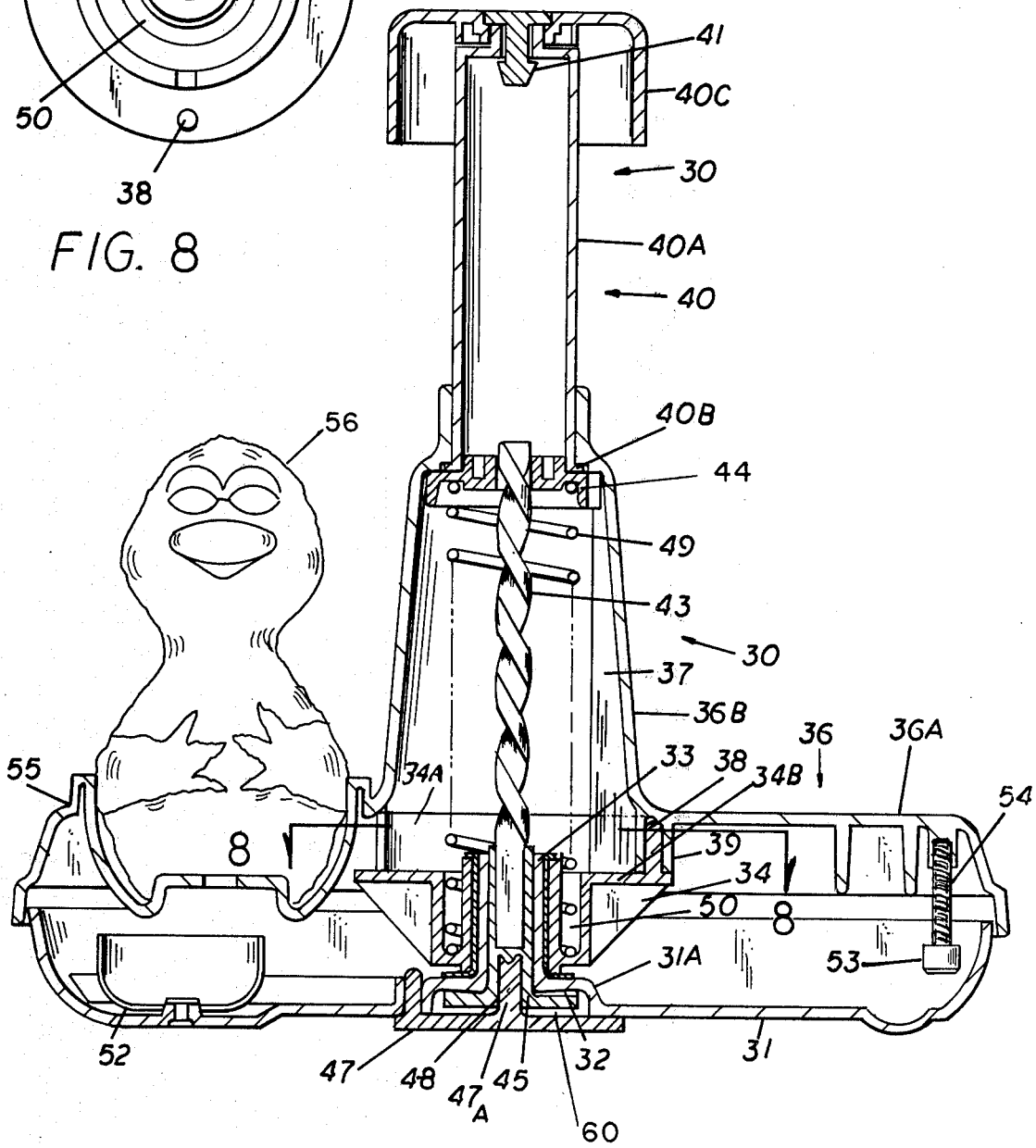
FIG. 3 is a vertical sectional view of a modified carousel top embodying the invention.

With the construction thus described, the top 30 is actuated by first depressing the plunger so that the driver 44 is longitudinally displaced along the twist bar 43. In doing so, the downward force of the driver will cause the teeth 46 of the clutch member 45 to become slightly spaced and disengaged from teeth 32 thus allowing the twist bar 43 to rotate independent of the turn table 36. Upon release of the downward pressure, the spring 49, which has been compressed, will expand to return the clutch member 45 and driver 44 to its upward position as shown on FIG. 3. In doing so, the driver 44 will rotate as it spirals upwardly along the twist rod 43. In doing so, the twisting force of the driver 44 exerts an upwardly axial force component on the clutch member 45 causing its teeth 46 to mesh with teeth 32 thereby prohibiting rotation of the twist rod 43. Thus, the driver 44 rotating relative to the twist rod 43 will impart a rotation to the turn table 36 which is undirectional; as the driver 44 is coupled to the turn table by the interengagement of webs 37 of the stem 36B with slots 44B of the driver 44. Thus each time the plunger 40 is depressed, the top 30 is primed to rotate whenever the force on the plunger is removed. As shown in FIG. 3, the bottom of the spring 49 is seated in a spring seat or recess 50 formed in the hub 34.

For additional play value the top 30 is provided with an audio sounding means to produce a pleasing sound as the turntable 36 rotates. As shown, the audio sounding means comprises a bell or tone bar 52 connected to the base 31. A striker or hammer 53, connected on the ends of a flexible member 54, is suspended from the turn table 36. The arrangement is such that as the turntable rotates, the striker 53 will strike the bell or tone bar and thereby sound a pleasing note or sound.

To simulate a carousel top, the turntable 36 is provided with one or more recesses 55 which defines a seat for detachably receiving an animated figure 56. The arrangement is such that the animated figure 56 is frictionally secured within the seat so that the centrifugal force imparted to the turn table will not cause the figure 56 to become dislodged from its seat. Yet the child, if desired, can effect ready removal of the figures 56 whereby they can be re-arranged as desired by the child. It will be understood that the animated figures may be either hollow or solid.

From the foregoing, it will be noted that a spinning top is provided which will spin on a base that remains stationary relative to its supporting surface. Thus a small child can be amused while remaining seated or confined to a given spot.

While the invention has been described with respect to several embodiments thereof, it will be readily appreciated that variations and modifications may be made without departing from the spirit or scope of the invention.

What is claimed is:

1. A carousel top comprising a base member for supporting said top on a supporting surface, an upper frame member connected to said base member, said upper frame member having opposed leg portions extending upwardly from said base member and a cross member interconnected between said leg portions, a turn table rotatably mounted on said base member, a clutch housing connected to said turn table, said turn table being spaced above said base member, audio sounding means connected to the leg portion of said upper frame member adjacent to the periphery of said turn table, a clutch member disposed in said housing, a driver in the form of a twist bar extending through said clutch member, said driver extending above said cross member and disposed in alignment with said clutch member, a spring means for normally biasing said driver toward an inoperative position, said twist bar being longitudinally displaceable relative to said clutch whereby it effects engagement of said clutch in one direction of displacement to effect the drive of said turn table, and to disengage said clutch when displaced in the opposite direction to render said turn table free wheeling, a striker mounted on said turn table to strike said audio sounding means as said table rotates, and detachable animated figures carried on said turn table.

2. A carousel top comprising:

a base means including a stand and a base member connected to said stand, said base member having a sleeve hub connected thereto, a turn table rotatably mounted on said sleeve hub, said turn table having connected thereto a projecting neck, a drive means for effecting rotation of said turn table relative to said base means, said drive means including a twist rod, a driver slidably mounted on said twist rod for longitudinal displacement relative to said twist rod within said neck and slidably connected to said neck, a clutch means connected to said twist rod, a spring for biasing said driver toward an operative position whereby said clutch means is engaged, a plunger slidably disposed in said neck and operatively connected to said driver, said plunger being slidably disposed for movement toward and away from said turn table whereby said driver is longitudinally displaced relative to said twist rod so as to effect disengagement of said clutch means as said plunger is moved toward said turn table and whereby said driver imparts rotation to said turn table upon release of said plunger, means defining a seat located on said turn table, and an animated figure removably disposed in said seat.

3. A carousel top as defined in claim 2 and including means for generating a sound as said turn table rotates.

4. A carousel top comprising:

a base means, a turn table rotatably mounted in said base means for rotation relative thereto, a drive means operatively connected to said turn table for imparting rotation thereto, said drive means including a clutch means for engaging and disengaging said drive means, and actuating means for actuating said drive means, wherein said drive means comprises a twist rod, a driver slidably mounted on said twist rod, said driver being slidably connected to said turn table, and arranged to rotate therewith, said twist rod having one end connected to said clutch means, and a spring means for maintaining a spring bias on said driver.

5. A carousel top as defined in claim 4 wherein said actuating means includes a plunger operatively connected to said driver for effecting longitudinal displacement of said driver relative to said twist bar, and said plunger being movable toward and away from said turn table, whereby said drive means imparts rotation to said turn table as said plunger is longitudinally displaced.

6. A carousel top as defined in claim 5 and including an audio means for imparting a musical sound as said turn table rotates.

7. A carousel top as defined in claim 6 wherein said audio means comprises a bell mounted on said base means, and a bell hammer mounted on said turn table whereby said hammer strikes said bell to emit said sound as the turn table rotates relative to said base means.

* * * * *